United States Patent [19]

Yamane et al.

[11] Patent Number: 4,505,129

[45] Date of Patent: Mar. 19, 1985

[54] SOLID AIR-CONDITIONING MACHINE

[75] Inventors: Masataka Yamane, Kusatsu; Akira Kusashio, Ohtsu; Satoru Kudaka, Kusatsu; Tatuhiro Kobayashi, Kusatsu; Yasuhiko Ebata, Kusatsu, all of Japan

[73] Assignee: Matsushita Electric Industrial Co., Ltd., Osaka, Japan

[21] Appl. No.: 490,156

[22] Filed: Apr. 29, 1983

[30] Foreign Application Priority Data

Apr. 30, 1982 [JP] Japan ..... 57-73601
Sep. 28, 1982 [JP] Japan ..... 57-170116

[51] Int. Cl.[3] ..... F25B 47/00

[52] U.S. Cl. ..... 62/280; 62/262; 62/507; 98/94.2

[58] Field of Search ..... 62/280, 262, 91, 279, 62/507

[56] References Cited

U.S. PATENT DOCUMENTS 4,120,170 10/1978 Witwell et al. ..... 62/280

FOREIGN PATENT DOCUMENTS 726379 1/1966 Canada ..... 62/280

*Primary Examiner*—Henry Bennett
*Attorney, Agent, or Firm*—Wenderoth, Lind & Ponack

[57] ABSTRACT

A self-contained air-conditioning unit which includes an outer box, a base plate slidably removably inserted in the outer box, and a bulkhead on the base plate partitioning the interior of the outer box into an indoor portion and an outdoor portion. A compressor and a condenser are provided adjacent a rear face of the outer box. In the outdoor portion are provided a compresser, and a condenser adjacent the rear face of the outer box. The condenser includes a central portion and left and right curved ends. An evaporator and an indoor fan are provided in the indoor portion. A fan motor drives the indoor fan and an outdoor fan which faces the central portion of the condenser. Air inlets having louvers are provided in the outer box adjacent the curved ends of the condenser. Blow-off ports are provided in the outer box between the outdoor fan and the bulkhead. A slinger ring is disposed on the outdoor fan to scatter condensed water on the base plate. Air inlet ports are also provided on the rear face of the outer box so as to oppose the central portion of the condenser. The outdoor fan is located so as to draw air through the inlet and the condenser to the blow-off ports such that some of the condensed water scattered by the slinger ring directly hits the condenser so as to be evaporated by the air drawn therethrough and some of the scattered water is directly carried by the air drawn through the condenser to the blow-off ports.

11 Claims, 16 Drawing Figures

SOLID AIR-CONDITIONING MACHINE

BACKGROUND OF THE INVENTION

The present invention relates to a self-contained air-conditioning unit with a compressor, a condenser, an evaporator, etc. accommodated within one box-shaped body.

Referring to FIG. 1 and FIG. 2, the main body of a conventional self-contained air-conditioning unit a was composed of a base plate b, a bulkhead e on the base plate b for dividing between the indooor draft route c and the outdoor draft route d, an outer box f, etc. An outdoor heat exchanger h is mounted against the rear face g in the outdoor draft route d. Also, a motor i was mounted on the bulkhead e so that the rotary shaft of the motor might become perpendicular to the bulkhead e. A propeller fan j was mounted at one end of the motor i so that the fan might blow the air towards the outdoor heat exchanger h. The propeller fan was provided with a ring p for raising the water located within the base plate b to blow it against the outdoor heat exchanger h. A compressor k together with the outdoor heat exchanger h performed the well known refrigerating cycle togeher with the outdoor heat exchanger h. An indoor heat exchanger m was mounted, facing the front face l, in the indoor draft route c. A multivane fan o was mounted, at the other end of the motor i, facing the indoor heat exchanger m and blew, into an air duct n, the air passing through the indoor heat exchanger m. The ideal draft route in this type of air-conditioning unit has low resistance to air flow. Accordingly, the heat exchanger is required to have a wider cross-sectional area (hereinafter referred to as front-face area) and the draft route is required to be shorter (hereinafter referred to as row number), wider, smoother and less-curved. Such characteristics as described hereinabove constitute those of a draft route of smaller draft resistance, allowing a self contained air-conditioning unit to be realized which is capable of ventilating the air with lower noises and larger amounts of air with the use of a motor of small capacity.

However, the conventional self-contained air-conditioning unit was mounted through a wall or in a window. The area of the front face was made as small as possible so that a large hole might not be necessary to be made or the lighting through the window would not be overly diminished.

Also, this type of conventional air-conditioning unit was made smaller in size to reduce the cost. As the indoor multivane fan o and the outdoor propeller fan j were simultaneously driven by one motor i as shown in FIG. 1 and FIG. 2, an indoor heat exchanger m and an outdoor heat exchanger h were obliged to be disposed, respectively, along the front face and the rear face g of the self-contained air-conditioning unit a. Accordingly, the indoor and outdoor draft routes c and d for respectively ventilating the air into the heat exchangers m and h were obliged to become narrower and curved routes.

Thus, a motor i of much larger capacity was required for the draft, and the front face area of each of the heat exchangers m and h was obliged to become smaller. Each of the heat exchangers m and h was caused to be longer in the number of stages and to be greater in depth, thus resulting in the motor i and the heat exchangers m and h being of higher cost. This result became contrary to an initial object of using one fan motor i to lower the price. Also, the conventional self-contained air-conditioning unit was not good even with regard to the draft route construction. Namely, since two fans o and j were desired to be mounted at the ends of one motor i within a restricted box-shaped body as described hereinabove, the shapes on the inlet side and the blow-off sides of the multivane fan o and the propeller fan j were not formed to allow the fans o and j to be driven at lower noise levels. Also, since the ring p faced the horizon at an approximately right angle within the base plate b, its capacity to raise and efficiency in raising the condensed water was smaller, thus contributing little towards improving the capacity of the heat exchanger. In addition, as large water drops flew when the water was raised, larger noises were caused.

As described hereinabove, the conventional construction of the self-contained air-conditioning unit had disadvantages in that large noises were inevitably caused, a motor of large capacity was required, and the condensed water coming from the indoor heat exchanger could not be efficiently disposed of.

OBJECTS OF THE INVENTION

An object of the present invention is to provide a self-contained air-conditioning unit, which can improve the air flow efficiency and reduce the noises through the construction of an outdoor air flow circuit including a condenser, to pass the air through the outdoor fan from an air-intake louver to direct it into blow-off ports from the condenser.

Another object of the present invention is to provide a self-contained air-conditioning unit, which can prevent outdoor air-flow leakage into the indoors from reducing the cooling efficiency of the unit through provision of a seal material on the inner face of the outer box to isolate the outdoor air flow circuit from the indoor side of the outer box.

A further object of the present invention is to provide a self contained air-conditioning unit, which reflects, into the outdoor air flow circuit, the condensed water scattered by a slinger ring through provision of water flight preventing plates on opposite side portions of the condenser, the condenser being U-shaped and being provided with the opposite side portions, thereby to improve the heat exchange efficiency of the condensed water in the outdoor heat exchanger.

Still a further object of the present invention is to provide a self-contained air-conditioning unit, which can improve the heat exchange efficiency for cooling air in the outdoor heat exchanger through provision of ventilation holes in the water flight preventing plates.

Another important object of the present invention is to provide a self-contained air-conditioning unit, which prevents the condensed water from being scattered from the ventilation hole through the construction of the ventilation holes, formed in the water flight preventing plate, so that the air might flow meanderingly.

BRIEF SUMMARY OF THE INVENTION

According to the present invention, there is provided a self-contained air-conditioning unit wherein the main body of an air-conditioning unit is composed of an outer box formed in a rectangular box shape, a base plate accommodated for drawing-out operation in the outer box, a bulkhead disposed on the base plate to partition the interior thereof into an outdoor portion and an indoor portion, a U-shaped condenser with bent portions provided on the right and left ends, a compressor and an outdoor fan disposed on said outdoor side, an evaporator which together with said condenser and compressor, performs the refrigeration cycles and an indoor fan, disposed on said indoor side; a fan motor for driving said outdoor fan an indoor fan mounted on said bulkhead; a louver for air inlet use opposite the bent portion of said condenser; and blow-off ports located between said outdoor fan and the bulkhead provided respectively on the side walls on the outdoor side in said outer box. The rear face openings of said outer box as the air inlet ports are located to oppose the central portion of said condenser, a slinger ring which is adapted to scatter the condensed water remaining on said base plate being disposed on said outdoor fan, said outdoor fan being rotated so that the air may flow into the blow-off ports from said inlet ports and the louver for air inlet use.

BRIEF DESCRIPTION OF THE DRAWINGS

These and other objects and features of the present invention will become more apparent from the following detailed description of the preferred embodiment thereof with reference to the accompanying drawings in which.

DETAILED DESCRIPTION OF THE PREFERRED EMBODIMENTS

Figure 1:
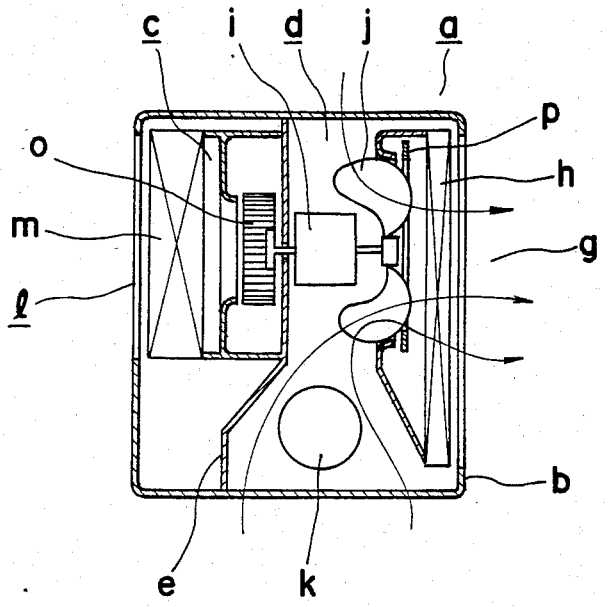
FIG. 1 is a cross-sectional plan view showing a conventional self-contained air-conditioning unit conventional as already referred to above.
Figure 2:
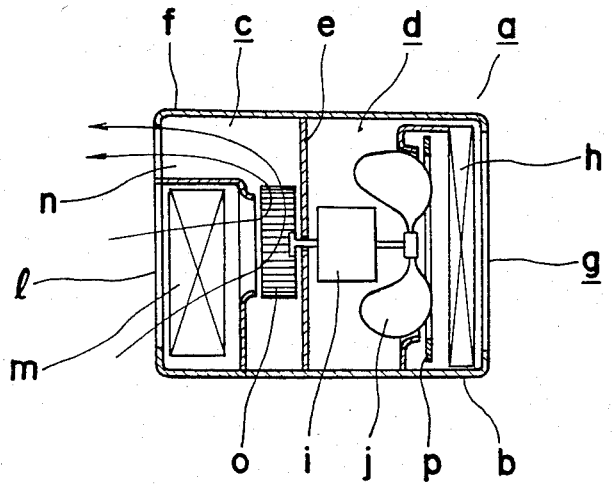
FIG. 2 is a cross-sectional side view of the air-conditioning unit of FIG. 1.

Before the description of the present invention proceeds, it is to be noted that like parts are designated by like reference numerals throughout the several views of the accompanying drawings.

Figure 3:
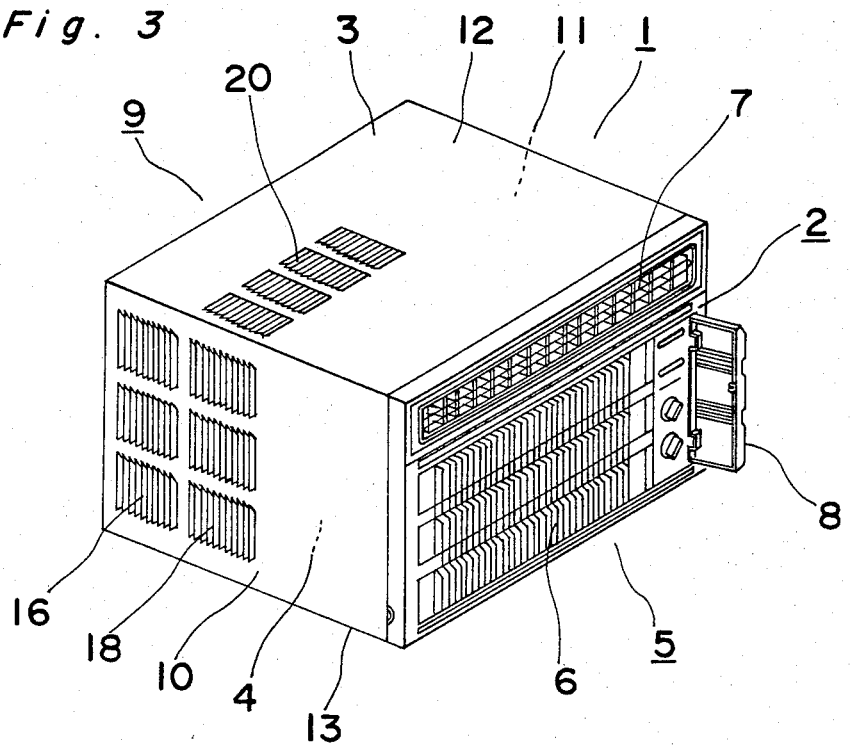
FIG. 3 is a perspective view, seen from the front face side of the first embodiment of the self-contained air-conditioning unit of the present invention.
Figure 4:
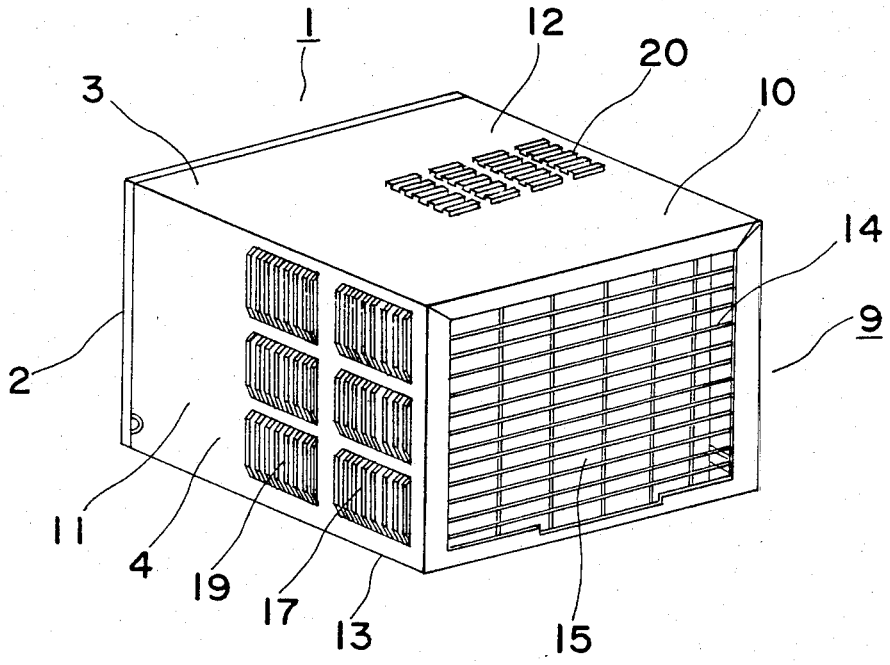
FIG. 4 is a perspective view, seen from the rear face side of the air-conditioning unit of FIG. 3.
Figure 5:
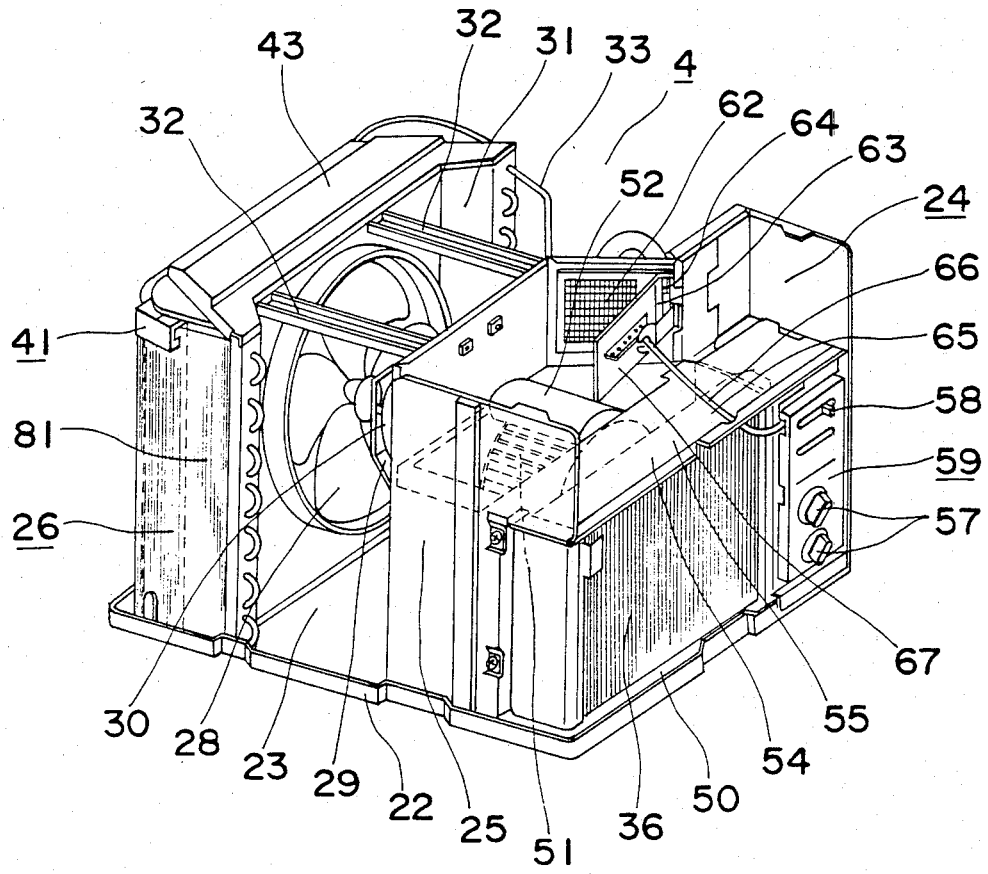
FIG. 5 is a perspective view, seen from the front face side of the inner unit, on an enlarged scale, in the air-conditioning unit of FIG. 3.
Figure 6:
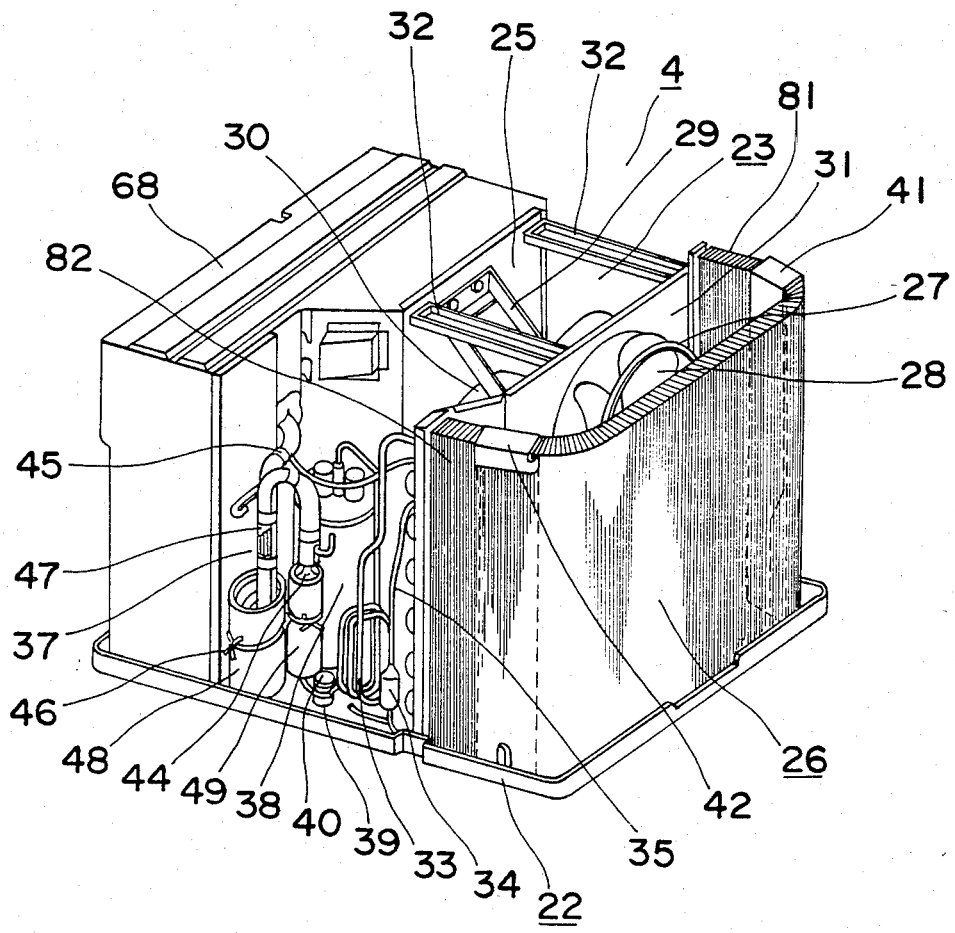
FIG. 6 is a perspective view, seen from the rear face side of the inner unit in the air-conditioning unit of FIG. 5.

Referring to FIG. 3 and FIG. 4, the main body 1 of a self-contained air-conditioning unit is composed of a front face grille 2, an outer box 3 having a guard screen 14, and an inner unit 4, which is accommodated, in outer box 3 so as to be capable of being withdrawn and reinserted therein. The front face grille 2, which is mounted on the front face 5 on the main body 1, is provided with inlet ports 6, blow-off ports 7 and an control unit cover 8. Also, the outer box 3, which is composed of a rear face 9, a left-hand side face 10, a right-hand side face 11, a top face 12 and a bottom face 13, is formed in a rectangular box shape. The rear face 9 is provided with inlet ports 15, on which the guard screen 14 is mounted. Also, the left and right side faces 10 and 11 are provided, respectively, with louver-shaped left side face inlet ports 16 and right side face inlet ports 17 on the sides of the rear face 9 thereof. Also, the left and right side faces 10 and 11 are provided, respectively, with louver-shaped left side face blow-off ports 18 and right side face blow-off ports 19, which are adjacent, respectively, to the left side face inlet ports 16 and the right side face inlet ports 17. Furthermore, the top face 12 is provided with louver-shaped blow-off ports 20 on the side thereof adjacent left side face 10.

The inner unit 4 of a self-contained air-conditioning unit will be described hereinafter with reference to FIG. 5 through FIG. 8.

Referring to FIG. 5 through FIG. 8, the inner unit 4 is composed of a base plate 22 and a bulkhead 25 which is welded on the base plate 22 to divide the interior between an outdoor draft route 23 and an indoor draft route 24. The outdoor draft route 23 includes a U-shaped condenser 26, which is mounted oppositely to the inlet ports 15 of the rear face 9 of the outer box 3, to the left inlet ports 16 on the left side face 10, and to the right inlet ports 17 on the right side face 11; a propeller fan 28 facing the central portion of condenser 26, provided with a slinger ring 27 for ventilating to radiate the heat of the condenser 26 and simultaneously scatter the water located on the base plate 22; a fan motor 30 for driving the propeller fan 28; a fan motor mounting plate 29 for mounting the fan motor 30 on the bulkhead 25; an air guider 31 welded on the base plate 22 to guide the air propelled by the propeller fan 28; a coupling crosspiece 32 welded like a bridge between the bulkhead 25 and the air guider 31 to reinforce the bulkhead 25 and the air guider 31; a compressor 38, a discharge pipe 33, a condenser 26, a strainer 34, a capillary tube 35, an evaporator 36 and an inlet pipe 37 together constituting the ring-shaped refrigerating cycle; support rubber 39 of the compressor 38; and a bolt 40 for securing the compressor 38 to the base plate 22. A left hand water flight preventing plate 41 and a right hand water flight preventing plate 42 are provided, respectively, on the left-hand side end portion and the right-hand side end portion so that the water flight preventing plates may be located in a water extending line along which the water tangentially flies by the rotation of the slinger ring 27 of the propeller fan 28. Also, a condenser cover 43 is provided on the top face of the condenser 26 and the air guider 31 to ensure the air tightness of the draft route and to prevent the scattering of the water drops. The accumulator 44 of the inlet pipe 37 and the compressor 38 are wound with adiabatic materials 47, 48, 49 through tape 45, belt 46, etc. Also, the condenser 26 is screwed at its both ends into both ends of the air guider 31, and is secured onto the base plate 22.

Also, the indoor draft route 24 includes an evaporator 36, which is disposed opposite to the inlet ports 6 of the front face grille 2 and is engaged, at its left end, with the bulkhead 25, a water receiving saucer 50 for storing condensed water formed by the evaporator 36 to guide it to the side of the outdoor draft route 23, a silocco fan 51 mounted on the shaft of the fan motor 30 for sending the draft to the evaporator 36, an air guider 52 for the silocco fan 51, made of adiabatic vesicatory body, the silocco air guider side-plate 55, which serves as the blast ports 53 for the air flow blown by the silocco fan 51 and the top face cover 54 of the evaporator 36, a duct 56 made of adiabatic vesicatory body for guiding, to the blow-off ports 7 of the front-face grill 2, the air flow blown off from the silocco fan 51, an central unit 59 which accommodates electric components or the like therein and has electric-component control knobs 57, a ventilation door control knob 58, etc., an insect screen 62 disposed in the ventilation opening 61 located in the refraction portion 60 of the bulkhead 25, a ventilation door 67 for opening or shutting the ventilation opening 61 through the operation of the ventilation-door control knobs 58 through a wire 68 disposed within a cylindrical housing, and being secured, at one end 64 of its hinge unit 63, to the bulkhead 25, and an indoor top face cover 68 for protecting the duct 56 and simultaneously retaining the integrity of the bulkhead 25.

The construction of the outer box 3 and the seal material will be described hereinafter with reference with FIG. 7 through FIG. 11.

Figure 7:
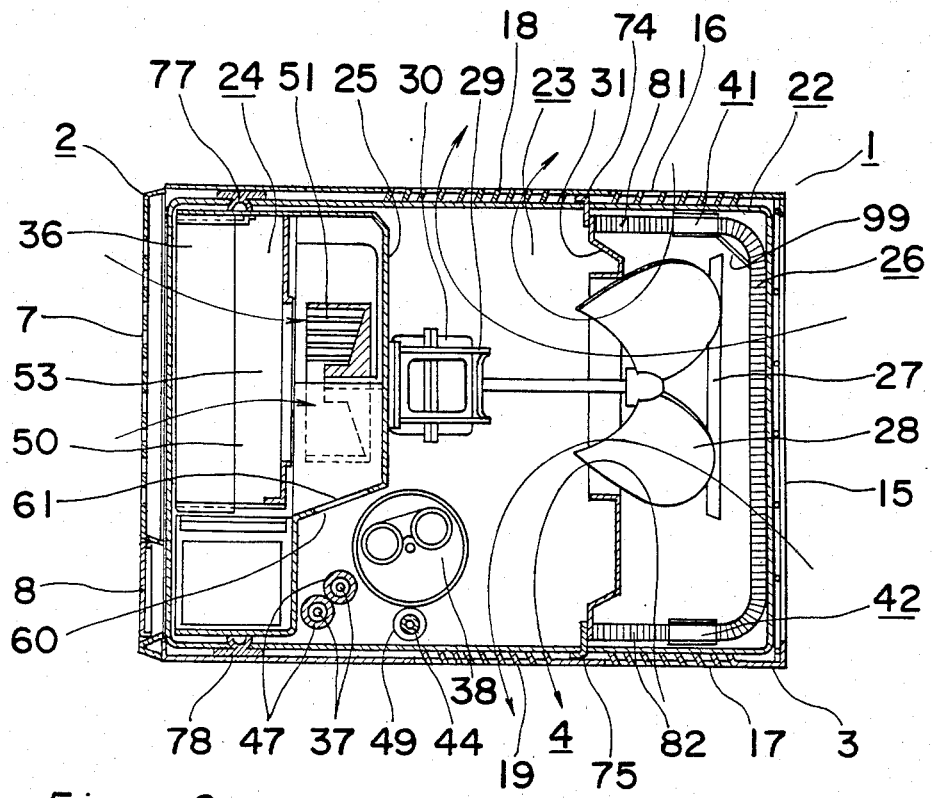
FIG. 7 is a cross-sectional plan view of the air-conditioning unit of FIG. 3.
Figure 8:
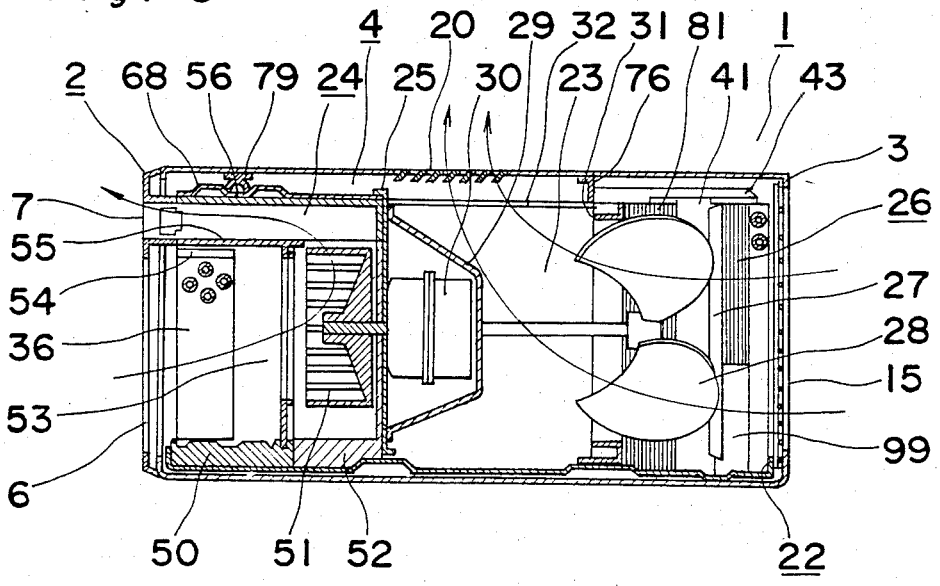
FIG. 8 is a cross-sectional side view of the air-conditioning unit of FIG. 7.
Figure 9:
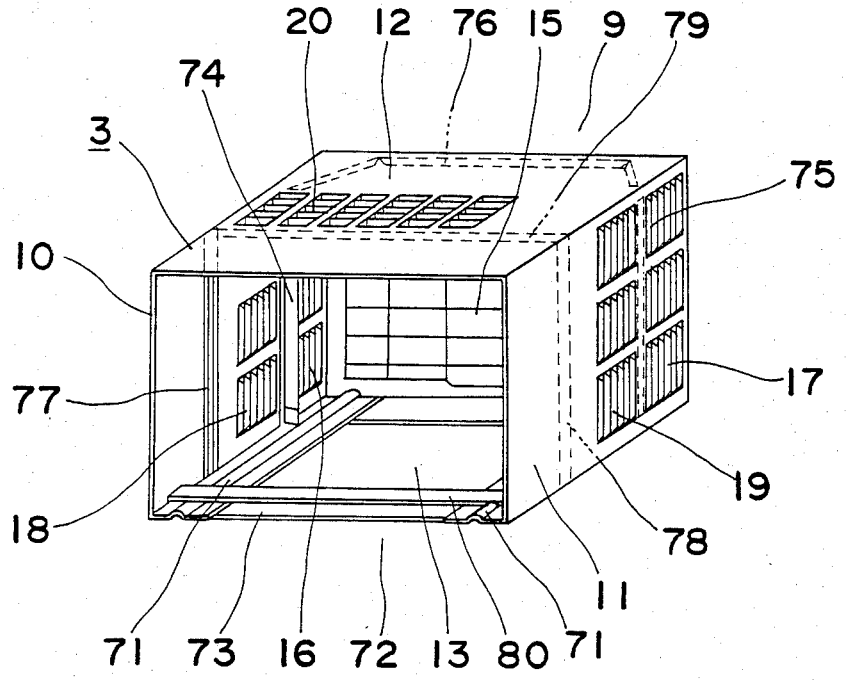
FIG. 9 is a perspective view of an outer box in the air-conditioning unit of FIG. 3.
Figure 10:
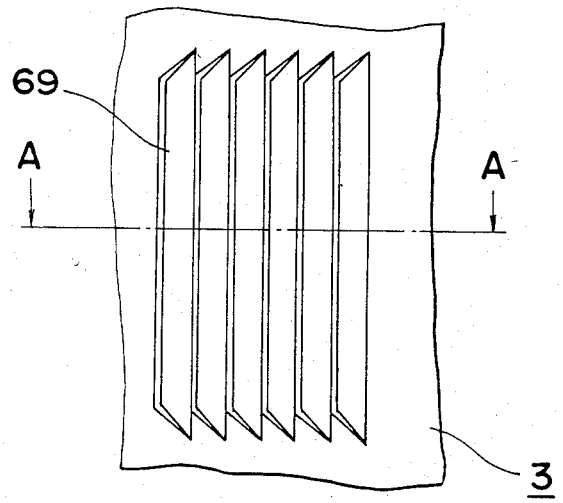
FIG. 10 is a plan view of louver portions in the outer box of FIG. 9.
Figure 11:
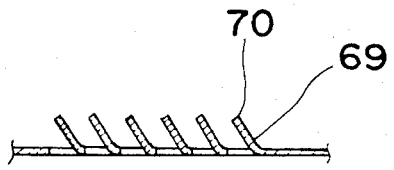
FIG. 11 is a cross-sectional view taken along the line A—A in FIG. 10.
Figure 12:
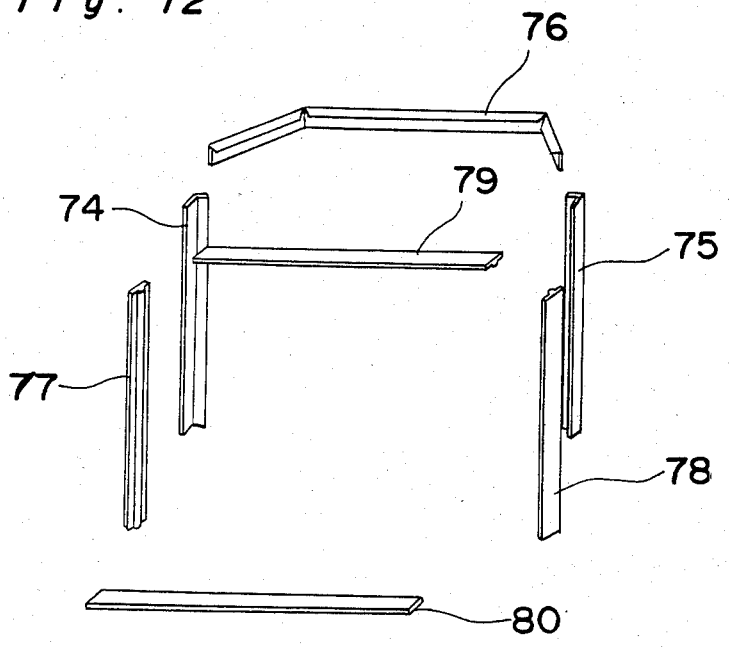
FIG. 12 is a perspective view showing the arrangement of the seal members in the air-conditioning unit of FIG. 3.

Referring to FIG. 7 through FIG. 11, the outer box 3, as described hereinabove, has inlet ports 15 in its rear face 9. The left side face 10 of the box is provided with left side face inlet ports 16 and their adjacent left side face blow-off ports 18 formed on the side of the rear face 9. Also, the right side face 11 of the box is provided with right side face inlet ports 17 and their adjacent right side face blow-off ports 19 formed on the side of the rear face 9. The top face 12 is provided with blow-off ports 20. The blow-off ports 20 of the top face 12, the right and left side face inlet ports 16 and 17, the right and left, side face blow-off ports 18 and 19 are composed of air flow direction varying plates 69, each having a given angle as shown in FIG. 10 and FIG. 11. The respective air flow direction varying plates 69 are bent towards the bulkhead 25 as shown in FIG. 7 and FIG. 8. Also, both sides of the bottom face 13 in the outer box 3 are provided by bending extended portions of the left and right side faces 10 and 11. Semi-circular rails 71 are provided towards the interior of the outer box 3 along the right and left side faces 10 and 11. The inner unit 4 is drawn out and pushed into outer box 3 with the base plate 22 placed on the rails 71. Also, the respective rails 71 are coupled by a coupling crosspiece 73 onto the side of the front face 72 of the outer box 3 to ensure the integrity of the outer box 3.

The seal members 74, 75 and 76 are pasted on the inner faces of the left side face 10 the right side face, 11 and the top face 12, respectively, to prevent air flow from leaking between the left side face inlet ports 16 and the left side face blow off ports 18, between the right side face inlet ports 17 and the left side face blow off ports 19, and between the inlet ports 15 of the rear face and the blow-off ports 20 of the top face 12. Also, seal members 77, 78, 79 and 80 are respectively pasted on the left side face 10, the right side face 11, the top face 12 and the coupling crosspiece 73, thereby to prevent the air flow and misty moisture flowing along the outdoor draft route 23 from passing throuugh clearances between the bulkhead 25 and the base plate 22, and between the top face cover 68 and the outer box 3.

Figure 13:
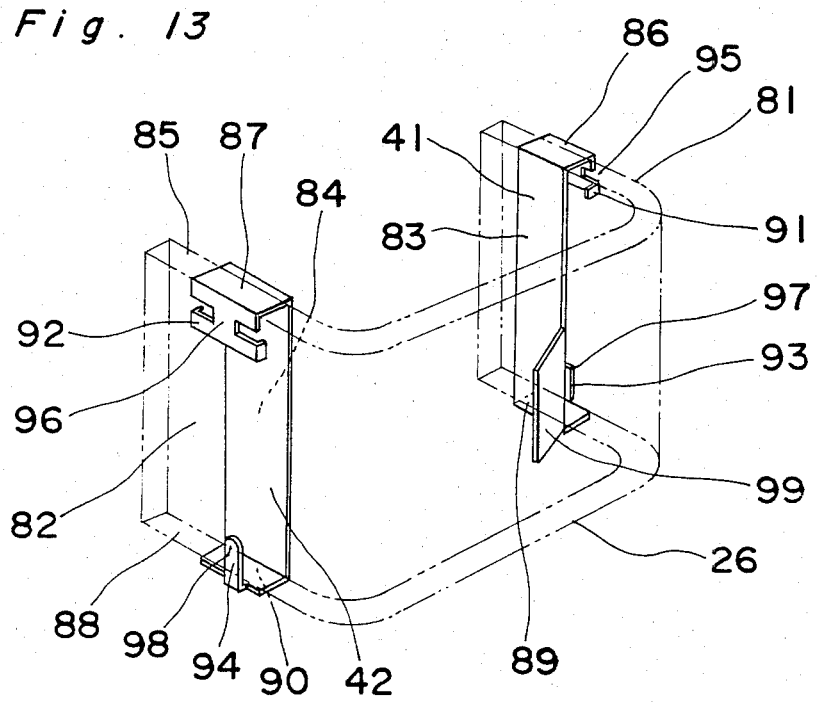
FIG. 13 is a perspective view showing how the water flight preventing plates are mounted on the condenser in the air-conditioning unit of FIG. 3.

A left hand water flight preventing plate 41 and right hand water flight preventing plate 42 mounted on the condenser 26 will be fully described hereinafter with reference to FIG. 7, FIG. 8 and FIG. 13.

Referring to these drawings, the U-shaped condenser 26 has the right and left water flight preventing plates 41 and 42 mounted, respectively, on the positions falling on the water extending line of the slinger ring 27 in the propeller fan 28 in the left bent portion 81 and the right bent portion 82. The respective right and left water flight preventing plates 41 and 42 face the left side face inlet ports 17 and the right side face inlet ports 18 formed on the outer box 3, and are composed of water flight preventing units 83 and 84 which are adapted not to let the water scattered by the slinger ring 27 move outside through the condenser 26 and top face hooking units 86, 87 to be hooked on the top face 85 of the condenser 26, the bottom face hooking units 89, 90 to be hooked on the bottom face 88 of the condenser 26, and cap members 95, 96, 97 and 98 which respectively extend from the top face hooking units 86 and 87 and the bottom face hooking units 86 and 90 to prevent disengagement from the condenser and are provided with griping pawls 91 and 92 hooking pawls 93 and 94 with respect to the condenser 26. Also, a water stop plate 99 is disposed on the rear face under the left water flight preventing plate 41 to receive the water flow before the water flow becomes water drips by the slinger ring 27, thereby to prevent the water flow from flying out of the condenser 26.

The window flow in a case where the fan motor 30 has been operated will be described for the above-described construction. When the fan motor 30 has been operated by the control of the control knobs 57 for the electric components, a propeller fan 28 and a silocco fan 51, which are mounted on the shaft ends of the fan motor 30, are rotated. In the outdoor draft route 23, the air drawn respectively from the inlet ports 15 of the outer box 3, the left side face inlet ports 16 and the right side face inlet ports 17 as shown with arrow marks of FIG. 7 and FIG. 8, passes the condenser 26 at approximately uniform speed. The air drawn through the air guider 31 by the propeller fan 28 and is blown off from the top face draft ports 20, the left side face blow-off ports 18, the right side face blow-off ports 19. Also, in the indoor draft route 24, the air drawn from the inlet ports 6 of the front face grille 2 as shown with arrow marks of FIG. 7 and FIG. 8 passes through the evaporator 36 and is fed to a duct 56 by the silocco fan 51 through the inlet ports 53. The air is fed indoors from the blow-off ports 7 of the front face grille 2.

When the compressor 38 is driven by the operation of the control knobs 57 for the electric components, high-temperature gaseous cold medium sent from the compressor 38 to the discharge pipe 33 is fed to condenser 26 and is efficiently cooled by the air uniformly flowing through the condenser 26 so as to become a high-temperature fluid cold medium. It passes through a strainer 34 to go through the capillary tube 35. It becomes a low-pressure gas-liquid mixture during the above-described period and moves to the evaporator 36. In the evaporator 36, the mixed gas-fluid cold medium, which absorbs heat from the air passing through the evaporator 36, becomes gaseous, and is again drawn to the compressor 38 through a pipe 37 around which adiabatic materials 47, 48 and 49 are wound, and an accumulator 44 of the compressor 38.

When the compressor 38 is driven like this, the air passing through the evaporator 36 is robbed of heat and moisture. Accordingly, the moisture condenses on the surface of the evaporator 36 and drips onto a water-receiving saucer 50 under the evaporator 36 so that it may be guided to the outer draft route 23 of the base plate 22. The condensed water remaining on the base plate 22 is raised by the slinger ring 27 of the propeller fan 28.

The water adhered to the slinger ring 27 is scattered in the circular direction of the slinger ring 27 to hit against the left bent portion 81 and the right bent portion 82 of the condenser 26. With nothing to prevent it from doing so, the water would passes through the left bent portion 81 and the right bent portion 82 and flies out of the condenser 26. However, as left water flight preventing plate 41 and a right water flight preventing plate 42 are disposed, in a position on the water extending line of the slinger ring 27, in the left bent portion 81 and the right bent portion 82 facing the left side face inlet ports 16 and the right side face inlet portion 17 of the outer box 3. The scattered water hits against the water flight preventing plates to prevent the water from flying through the condenser 26. In addition, the left water flight preventing plate 41 receives the water before it becomes water drops to prevent the water flight from the condenser 26, so that the wasteful reduction of the condensed water may be controlled. Also, some portion of the water raised by the slinger ring 27 becomes misty and goes to the blow off ports 20, the left side face blow-off ports 18 and the right side face blow-off ports 19 in air flowing against the side of the bulkhead 25 after passing through the condenser 26. At this time, the misty water droplets hit the louver airflow direction varying plate 69, and do not fly out of the outer box 3.

Also, the warm air and the misty droplets, which pass through the condenser 26 and against the bulkhead 25 are stopped by the seal members 77, 78, 79 and 80 between the bulkhead 25 and the outer box 3 so that they may not enter the indoor draft route 24. Also, the seal members 74, 75 and 76 pasted on the inner portion of the outer box prevents the air flow passing through the air guider 31 from being drawn into the inlet ports 15 of the rear face 9 and the right and left inlet ports 16 and 17 of the right and left side faces 10 and 11 through the clearance of the outer box 3.

The following effects are provided by such a self-contained air conditioning machine as described hereinabove.

(1) As the air passing through the condenser 26 flows without turbulence in accordance with the air inlet operation of the propeller fan 28, the noise can be reduced below that of the conventional case where a condenser is disposed on the blow-off side of the propeller fan 28. As the air inlet operation is performed from the side of the condenser 26, a wider air inlet area can be provided, thus resulting in improved heat exchange performance of the conndenser 26.

(2) Also, as the air blown off from the propeller fan 28 passing through the condenser 26 smoothly flows towards the blow-off ports 18 and 19 and 20 of the top face 12 and right and left side faces 10 and 11 of the outer box 3, a smaller draft resistance on the outside draft route is provided, thus requiring a smaller output of the motor 30. Also, as the air flow is smooth towards the outer box 3, the distance between a bulkhead 25 and the air guider 31 can be made smaller, thus allowing the outdoor draft route to be made compact. Accordingly, as the longer distance between the blower of the draft route on the inner side of the isolated chamber and the evaporator 36 can be provided, the noises of the indoor blower can be reduced.

(3) Also, the condensed water raised by the slinger ring 27 of the propeller fan 28 directly hits against the condenser 26 to improve the performance of the condenser 26. The water flight preventing plates 41 and 42 are disposed in a portion falling on the water extending line of the slinger ring 27 of the condenser 26 to prevent the water from flying outside through the heat exchanger, thus resulting in improved performance of the condenser.

(4) Some portion of the condensed water raised by the slinger ring 27 hits against the louver-shaped wind direction varying plates 69, whose tip ends are directed at the side of the bulkhead 25, to prevent the water from flying outside. Also, the warm air and moisture going to the indoor draft route through the clearance between the bulkhead 25 and the outer box 3 is stopped by the bulkhead 25 and the seal materials 77, 78 and 79 disposed between the bulkhead top face portion and the outer box 3. Thus water is prevented from going onto the indoor side and a cooling capability decrease due to entry of the warm air is prevented. Also, as the cold-temperature duct of suction pipe 37, compressor 38, accumulator 44, etc. has adiabatic materials 47, 48 and 49 disposed thereon for adiabatic operation so that an endothermic operation may not be effected from the warm air flow sent by the propeller fan 28, the cooling operation can be efficiently effected without any decrease in the suction efficiency of the compressor 38.

The second embodiment of the present invention will be described hereinafter with reference to FIG. 14 through FIG. 16 of the accompanying drawings. As the water flight preventing plate is different in construction in comparison to the first embodiment, some portions associated with the preventing plate will be described. It is to be noted that like parts of the second embodiment are designated by like reference numerals in the first embodiment and the explanations thereof are eliminated for the sake of brevity.

Figure 14:
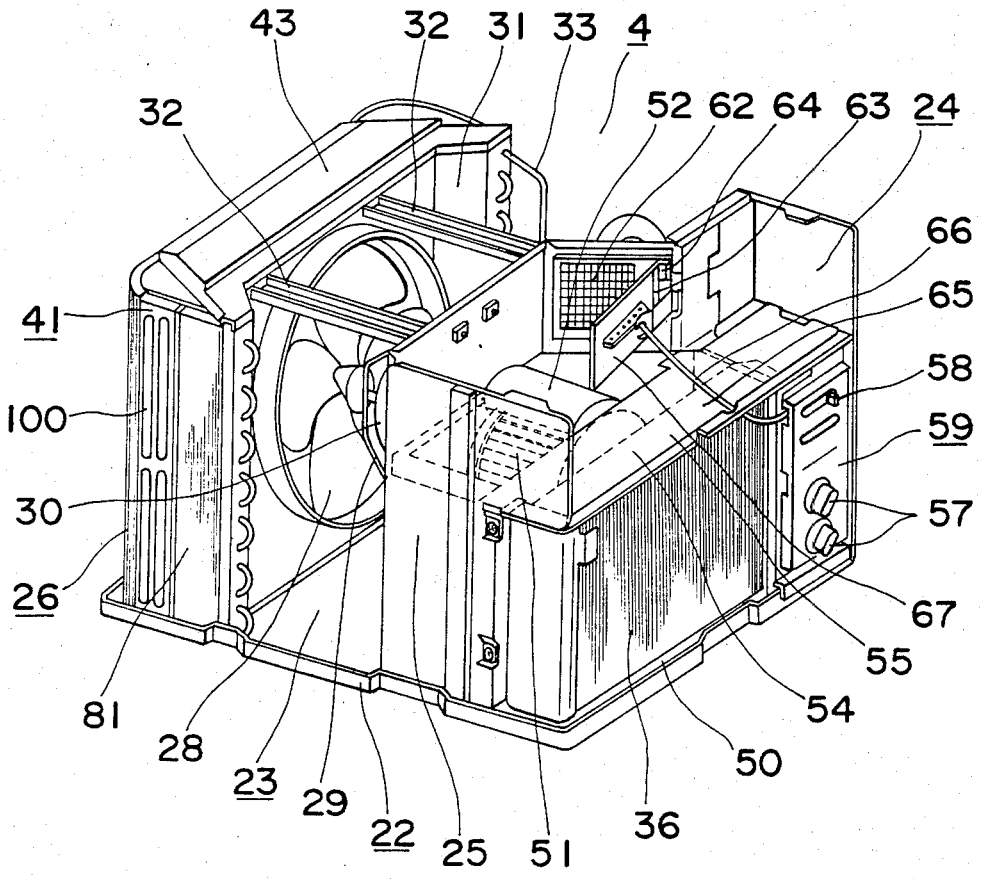
FIG. 14 is a perspective view, on an enlarged scale, seen from the front face side, showing the inner unit of the self-contained air-conditioning unit in a second embodiment of the present invention.
Figure 15:
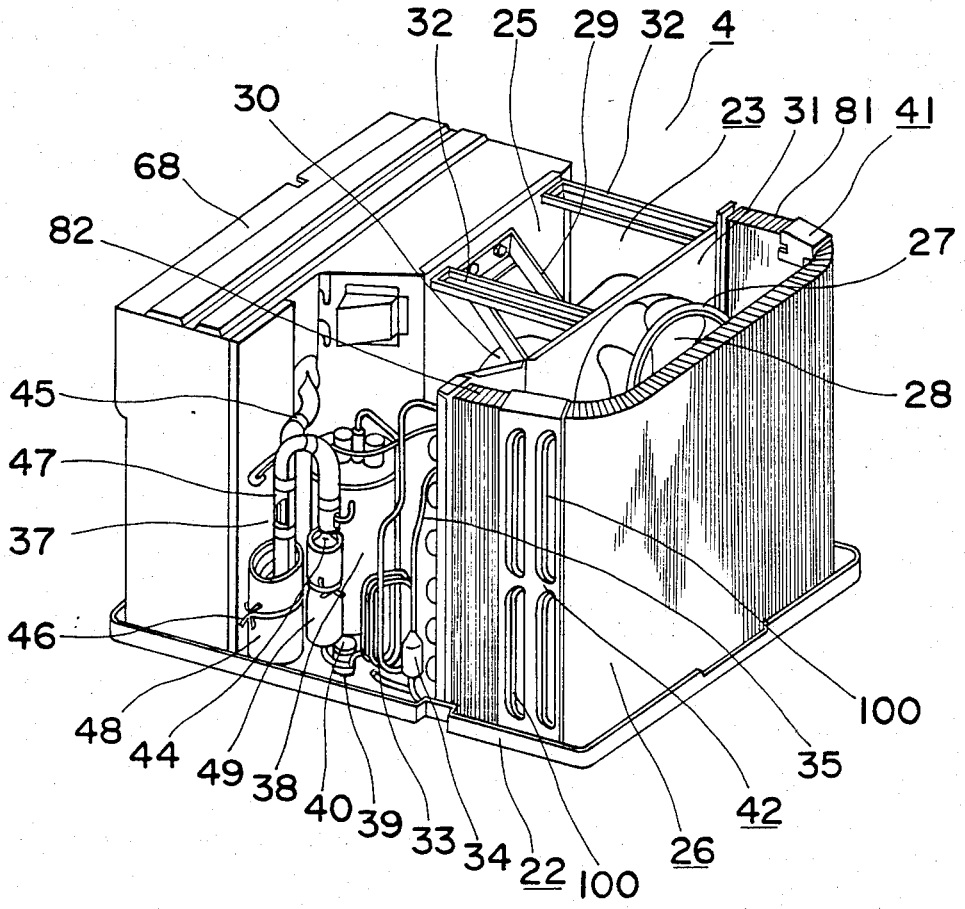
FIG. 15 is a perspective view, seen from the rear face side, of the inner unit in the air-conditioning unit of FIG. 14.
Figure 16:
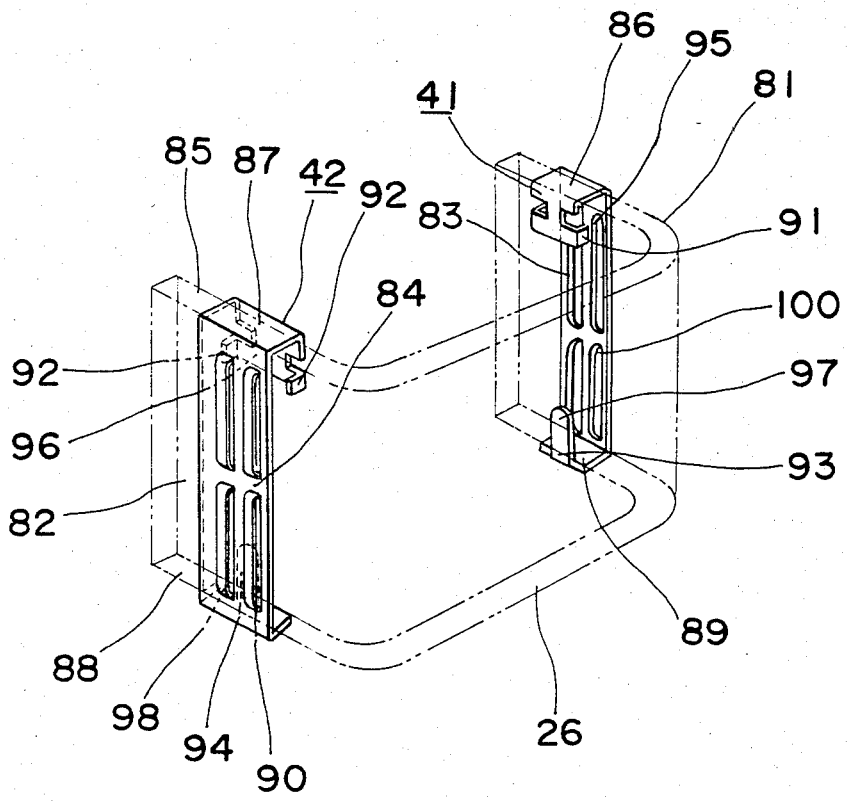
FIG. 16 is a perspective view showing how the water flight preventing plates are mounted on the condenser in the air-conditioning unit of FIG. 14.

Referring to FIG. 14 to FIG. 16 the mounting positions of the water flight preventing plates 41*a* and 42*a* and the mounting construction thereof are the same as those of the first embodiment. However, the construction and the mounting condition of the water flight preventing plates 41*a* and 42*a* are different from those of the first embodiment.

Namely, the water flight preventing plates 41*a* and 42*a* are provided with ventilation louvers 100, which extend in the same direction as that of the fins of the condenser 26, and are disposed on the outer sides of the right and left bent portions 81 and 82 in the condenser 26. The openings of the ventilation louver 100 are provided in the direction normal to the bent portions 81 and 82.

According to the construction, the following operational effects are provided in addition to the operational effects of the first embodiment.

Namely, the outdoor air meanderingly flows from the openings of the ventilation louvers 100 disposed in the right and left water flight preventing plates 41*a* and 42*a* through the suction operation of the propeller fan 28 thereby to perform the heat exchanging operation even in a portion covered by the right and left water flight preventing plates 41*a* and 42*a*.

Thus, the water passing through the condenser 26 hits against the water flight preventing plates 41*a* and 42*a* and louver 100 so that it may be prevented from being carried outdoors. In addition, the portion of the condenser 26 covered by the water flight preventing plates 41*a*, 42*a* can be cooled by the scattered water and air, thus resulting in improved performance of the heat exchanger.

In addition, to the second embodiment of the present invention, a water plate 99 shown in the first embodiment may be constructed integrally with the left-hand water flight preventing plate 41*a* when necessary.

Also, the present invention is described hereinabove for a self-contained air-conditioning unit designed exclusively for cooling use. The teachings can also be applied to a self-contained air-conditioning unit adapted for both cooling and heating use.

Although the present invention has been described and illustrated in detail, it is clearly understood that the same is by way of illustration and example only and is not be taken by way of limitation, the spirit and scope of the present invention being limited only by the terms of the appended claims.

What is claimed is:

1. A self-contained air-conditioning unit, comprising:

a main body, including an outer box having left and right side walls, top and bottom walls joining said side walls, and a rear face at one end of said side walls, a base plate slidably removably inserted in said outer box, and a bulkhead disposed on said base plate so as to partition the interior of said outer box into an indoor portion and an outdoor portion;

means, including a compressor and a condenser in said outdoor portion, and an evaporator and an indoor fan in said indoor portion, for cooling indoor air, said condenser being located adjacent said rear face and having a central portion and left and right curved ends on opposite sides of said central portion;

an outdoor fan in said outdoor portion directly facing said central portion of said condenser;

a fan motor mounted on said bulkhead and connected to said indoor and outdoor fans for driving said indoor and outdoor fans;

first air inlets having louvers in said left and right side walls, respectively opposite said left and right curved ends at said outdoor portion of said outer box;

blow-off ports in said side walls of said outer box between said outdoor fan and said bulkhead at said outdoor portion of said outer box;

a slinger ring disposed on said outdoor fan so as to scatter condensed water on said base plate, and second air inlets in said rear face opposing said central portion of said condenser;

said outdoor fan being located so as to draw air from each of said first and second air inlets respectively through said left and right ends and said central portion of said condenser to said blow-off ports such that some of the condensed water scattered by said slinger ring directly hits said condenser to be evaporated by the air drawn through said first and second air inlets and some of the condensed water scattered by said slinger ring is directly carried by the air drawn through the condenser to said blow-off ports.

2. A self-contained air-conditioning unit, comprising:

a main body, including an outer box having left and right side walls, top and bottom walls joining said side walls, and a rear face at one end of said side walls, a base plate slidably removably inserted in said outer box, and a bulkhead having left and right side faces and top and bottom faces, disposed on said base plate so as to partition the interior of said outer box into an indoor portion and an outdoor portion;

means, including a compressor and a condenser in said outdoor portion, and an evaporator and an indoor fan in said indoor portion, for cooling indoor air, said condenser being located adjacent said rear face having a central portion and left and right curved ends on opposite sides of said central portion;

an outdoor fan in said outdoor portion;

a fan motor mounted on said bulkhead and connected to said indoor and outdoor fans for driving said indoor and outdoor fans;

first air inlets having louvers in said left and right side walls, respectively opposite said left and right curved ends at said outdoor portion of said outer box;

blow-off ports in said side walls of said outer box between said outdoor fan and said bulkhead at said outdoor portion of said outer box;

a slinger ring disposed on said outdoor fan so as to scatter condensed water on said base plate;

second air inlet ports in said rear face opposing said central portion of said condenser; and seal material provided on said left, right, top and bottom walls of said outer box so as to respectively contact said left, right, top and bottom faces of said bulkhead so as to block airflow therepast between said bulkhead and said outer box;

said outdoor fan being located so as to draw air from each of said first and second air inlets through said condenser to said blow-off ports.

3. A self-contained air-conditioning unit as in claim 1, further comprising at least one water flight preventing plate, mounted on at least one of said left and right curved ends of said condenser adjacent the periphery of said slinger ring to reflect onto the side of said outdoor fan drops of water scattered tangentially by said slinger ring.

4. A self-contained air-conditioning unit as in claim 3, wherein said at least one water flight preventing plate includes left and right flight preventing plates respectively mounted on said left and right curved ends of said condenser.

5. A self-contained air-conditioning unit as in claim 3, wherein said at least one water flight preventing plate has a louver formed thereon.

6. A self-contained air-conditioning unit as in claim 5, wherein said louver includes openings which extend in a direction normal to the at least one of said left and right ends of said condenser so that the outdoor air meanderingly flows through said openings in response to the operation of said outdoor fan.

7. A self-contained air-conditioning unit, comprising:

a main body, including an outer box having left and right side walls, top and bottom walls joining said side walls, and a rear face at one end of said side walls, a base plate slidably removably inserted in said outer box, and a bulkhead having left and right side faces and top and bottom faces, disposed on said base plate so as to partition the interior of said outer box into an indoor portion and an outdoor portion;

means, including a compressor and a condenser in said outdoor portion, and an evaporator and an indoor fan in said indoor portion, for cooling indoor air, said condenser being located adjacent said rear face and having a central portion and left and right curved ends on opposite sides of said central portion;

an outdoor fan in said outdoor portion;

a fan motor mounted on said bulkhead and connected to said indoor and outdoor fans for driving said indoor and outdoor fans;

first air inlets having louvers in said left and right side walls, respectively opposite said left and right curved ends at said outdoor portion of said outer box;

blow-off ports in said side walls of said outer box between said outdoor fan and said bulkhead at said outdoor portion of said outer box;

a slinger ring disposed on said outdoor fan so as to scatter condensed water on said base plate;

second air inlet ports in said rear face opposing said central portion of said condenser; and at least one water flight preventing plate, mounted on at least one of said left and right curved ends of said condenser adjacent the periphery of said slinger ring to reflect onto the side of said outdoor fan drops of water scattered tangentially by said slinger ring;

said outdoor fan being located so as to draw air from each of said first and second air inlets through said condenser to said blow-off ports.

8. A self-contained air-conditioning unit as in claim 7, wherein said at least one water flight preventing plate includes left and right flight preventing plates respectively mounted on said left and right curved ends of said condenser.

9. A self-contained air-conditioning unit as in claim 7, wherein said at least one water flight preventing plate has a louver formed thereon.

10. A self-contained air-conditioning unit as in claim 9, wherein said louver includes openings which extend in a direction normal to the at least one of said left and right ends of said condenser so that the outdoor air meanderingly flows through said openings in response to the operation of said outdoor fan.

11. A self-contained air-conditioning unit as in claim 7, wherein said outdoor fan is located directly facing said central portion of said condenser between said left and right ends of said condenser.

* * * * *